US006256821B1

(12) United States Patent
Boyd

(10) Patent No.: US 6,256,821 B1
(45) **Date of Patent: *Jul. 10, 2001**

(54) MATTRESS SYSTEM

(76) Inventor: Dennis Boyd, 14457 Rogue River, Chesterfield, MO (US) 63017

( * ) Notice: Subject to any disclaimer, the term of this patent is extended or adjusted under 35 U.S.C. 154(b) by 0 days.

This patent is subject to a terminal disclaimer.

(21) Appl. No.: 09/327,694

(22) Filed: Jun. 8, 1999

Related U.S. Application Data

(63) Continuation of application No. 09/115,141, filed on Jul. 14, 1998, now Pat. No. 5,960,496.

(51) Int. Cl.[7] ..... A47C 27/15

(52) U.S. Cl. ..... 5/722; 5/727; 5/738; 5/739; 5/740

(58) Field of Search ..... 5/678, 680, 685, 5/722, 723, 727, 736, 738, 739, 740, 308, 710

(56) References Cited

U.S. PATENT DOCUMENTS

| | | | | |
|---|---|---|---|---|
| 1,528,066 | * | 3/1925 | McEntire | 5/722 |
| 3,521,311 | * | 7/1970 | Cohen | 5/727 |
| 3,745,596 | * | 7/1973 | Copeland | 5/308 |
| 4,189,798 | * | 2/1980 | Vessey | 5/678 X |
| 5,056,342 | * | 10/1991 | Prinz | 5/308 X |
| 5,105,488 | * | 4/1992 | Hutchinson et al. | 5/710 |
| 5,557,813 | * | 9/1996 | Steed et al. | 5/739 |
| 5,960,496 | * | 10/1999 | Boyd | 5/722 |

* cited by examiner

*Primary Examiner*—Michael F. Trettel
(74) *Attorney, Agent, or Firm*—Gregory E. Upchurch; Dennis J. M. Donahue, III; Thompson Coburn LLP

(57) ABSTRACT

A mattress system includes a first section of foam material forming the head section of a mattress, a second section of foam material forming, the central section of the mattress, and a third section of foam material forming the foot section of the mattress. The second section of foam material has a load responsive characteristic different from the load responsive characteristic of the first and third sections. The central section may be replaced by an inflatable air chamber.

18 Claims, 6 Drawing Sheets

MATTRESS SYSTEM

CROSS-REFERENCE TO RELATED APPLICATIONS

This application is a continuation of and claims the benefit of U.S. application Ser. No. 09/115,141 filed Jul. 14, 1998, now U.S. Pat. No. 5,960,496.

STATEMENT REGARDING FEDERALLY SPONSORED RESEARCH OR DEVELOPMENT

Not Applicable.

BACKGROUND OF THE INVENTION

The present invention relates to mattresses generally, and more particularly, to an improved mattress system with improved variability of load responsive characteristics.

Current conventional mattresses are known which are composed primarily of foam material. These foam mattresses are useful, but they could be improved. The foam material used for mattresses comes in high resilience and low resilience types. Unfortunately, high resilience foams, such as latex or viscoelastic foams, are relatively expensive as compared to less resilient foams such as polyurethane foams. Mattresses made from the more desirable high resilience foams can easily become too expensive for general use.

Conventional foam mattresses have a uniform firmness throughout the mattress. There is, in general, no provision for a different firmness in the lumbar area or for different firmnesses for different sides of the mattress (such as would be desirable for two sleepers of different sizes using the mattress at the same time). Nor is there any provision for adjusting the firmness once the mattress is in the hands of the customer. Even making changes in the firmness at the factory is difficult and expensive.

In addition, conventional foam mattresses made from lower resilience foam must be turned frequently (every few months). This requires that both the top and the bottom of the mattress have a cover (preferably quilted), which increases the cost of the mattress.

Moreover, conventional foam mattresses are so large that special provisions must be made for shipping them to the distributor, and to the end user.

SUMMARY OF THE INVENTION

Among the several objects and advantages of the present invention are the provision of a foam mattress system with improved comfort.

A second object is the provision of such a foam mattress system which is readily adjustable in terms of firmness at the factory or by the end user if desired.

A third object is the provision of such a foam mattress system which is relatively economical.

A fourth object is the provision of such a foam mattress system which does not require frequent turning.

A fifth object is the provision of such a foam mattress system which provides increased manufacturing flexibility.

A sixth object is the provision of such a foam mattress system which may be shipped by conventional common carriers such as UPS.

In a first aspect of the present invention, a mattress system includes a first section of foam material forming the head section of a mattress, a second section of foam material forming the central section of the mattress, and a third section of foam material forming the foot section of the mattress. The second section of foam material has a load responsive characteristic different from the load responsive characteristic of the first and third sections.

In a second aspect of the present invention, a mattress system includes a first section of foam material forming the head section of a mattress, an adjustable, inflatable air chamber forming the central section of the mattress, and a second section of foam material forming the foot section of the mattress.

The foregoing and other objects, features, and advantages of the invention as well as presently preferred embodiments thereof will become more apparent from the reading of the following description in connection with the accompanying drawings.

BRIEF DESCRIPTION OF THE DRAWINGS

Corresponding reference numerals indicate corresponding parts throughout the several figures of the drawings.

DESCRIPTION OF THE PREFERRED EMBODIMENT

Figure 1:
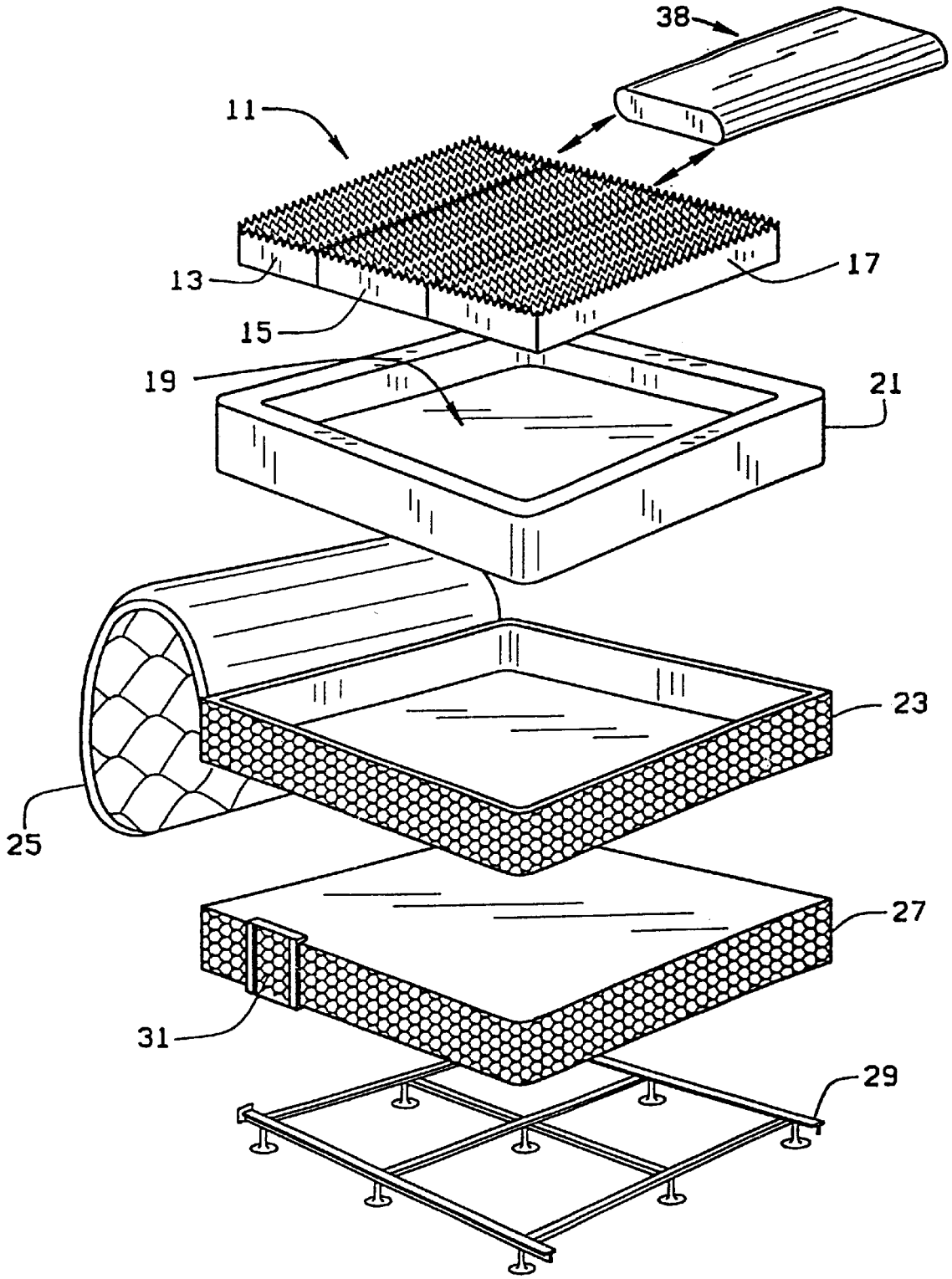
FIGS. 1–3 are exploded views of various embodiments of the mattress system of the present invention.

Turning now to the drawings, a mattress system 11 of the present invention is shown. Mattress system 11 includes three different regions of foam 13, 15, and 17. Section 13 forms the head section of a mattress, section 15 forms the central section of the mattress, and section 17 forms the foot section of the mattress. It is preferred that at least section 15 have a load responsive characteristic (such as density or indentation load deflection) which differs from that of sections 13 and 17. Alternatively, all three sections may have different load responsive characteristics. If desired, the center foam section may be replaced by an inflatable air chamber of the same shape 38.

For reasons which appear below, it is desired that all three sections have the same overall shape and size. It is also preferred that the tops and bottoms of each section have pattern formed therein such as the convolutions shown on the tops of the sections in FIG. 1. Different sections may have different patterns if desired.

Sections 13, 15 and 17 are composed of a high resilience foam such as latex or viscoelastic foam. It should be appreciated that the costs of the different sections may differ, depending upon the materials used and the load responsive characteristics of each section. Use of a high resilience foam eliminates the need to flip the mattress every few months as is recommended for conventional mattresses. This eliminates the expense of a quilted bottom panel, with its associated cost of an additional comfort layer and ticking.

It is preferred that sections 13, 15, and 17 be disposed in a cavity 19 defined by a foam member 21. As shown in FIG. 1, foam member 21 has four sides and a bottom. (See discussion of FIG. 1A below for an alternative construction.) Foam member 21 may be of variable heights to create a higher profile using a less expensive polyurethane foam, which adds value without dramatically increasing the cost of the mattress system. For example, a mattress of corresponding size made of high resilience foam such as latex or viscoelastic foam would be much more expensive.

If desired, mattress sections 13, 15, and 17, although with foam member 21 may be disposed in a cover 23 with a zippered top 25. This construction allows the cover to be completely removed to be cleaned or replaced. The top may have a comfort layer composed of polyurethane foam, viscoelastic foam, temperature sensitive foam, polyester fiber, cotton, or other natural fibers. The mattress system may be used with a conventional foundation/box springs 27, disposed on a metal frame 29. The foundation may have a hidden compartment 31 for jewelry or the like.

Figure 1A:
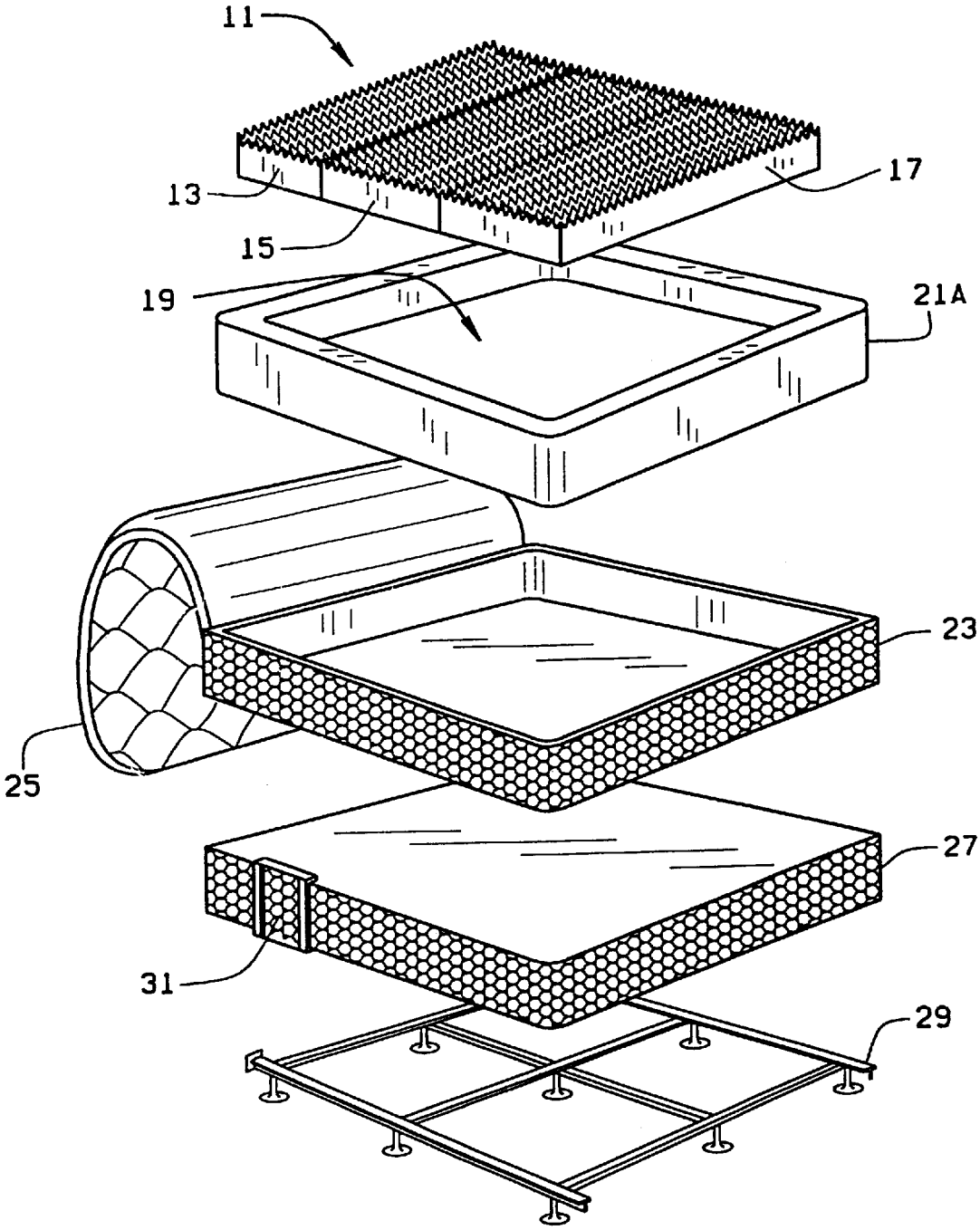

Turning to FIG. 1A, it can be seen that foam member 21 (here labeled 21A) need not have a bottom. Instead it may merely extend around the perimeter of the sections 13, 15, and 17. This allows the foam core to be flipped without flipping the entire mattress.

It should be noted that with the sections 13, 15 and 17 the same size and shape, it is possible either at the factory or in the home to adjust the load responsive characteristics of the mattress by simply rearranging the sections. (Use of a zippered cover facilitates this operation in the home.) If the three sections have three different load responsive characteristics (three different densities, for example), the mattress may be assembled in six different ways, with six different "feels." This versatility may be increased even further by the construction shown in FIG. 2 in which there are six different foam sections 13A, 13B, 15A, 15B, 17A, and 17B, three on each side of the mattress. The sections may be of up to six different load responsive characteristics. Preferably the sections are the same size and shape, so that with this construction any permutation of six foam sections may be constructed as desired.

Figure 2:
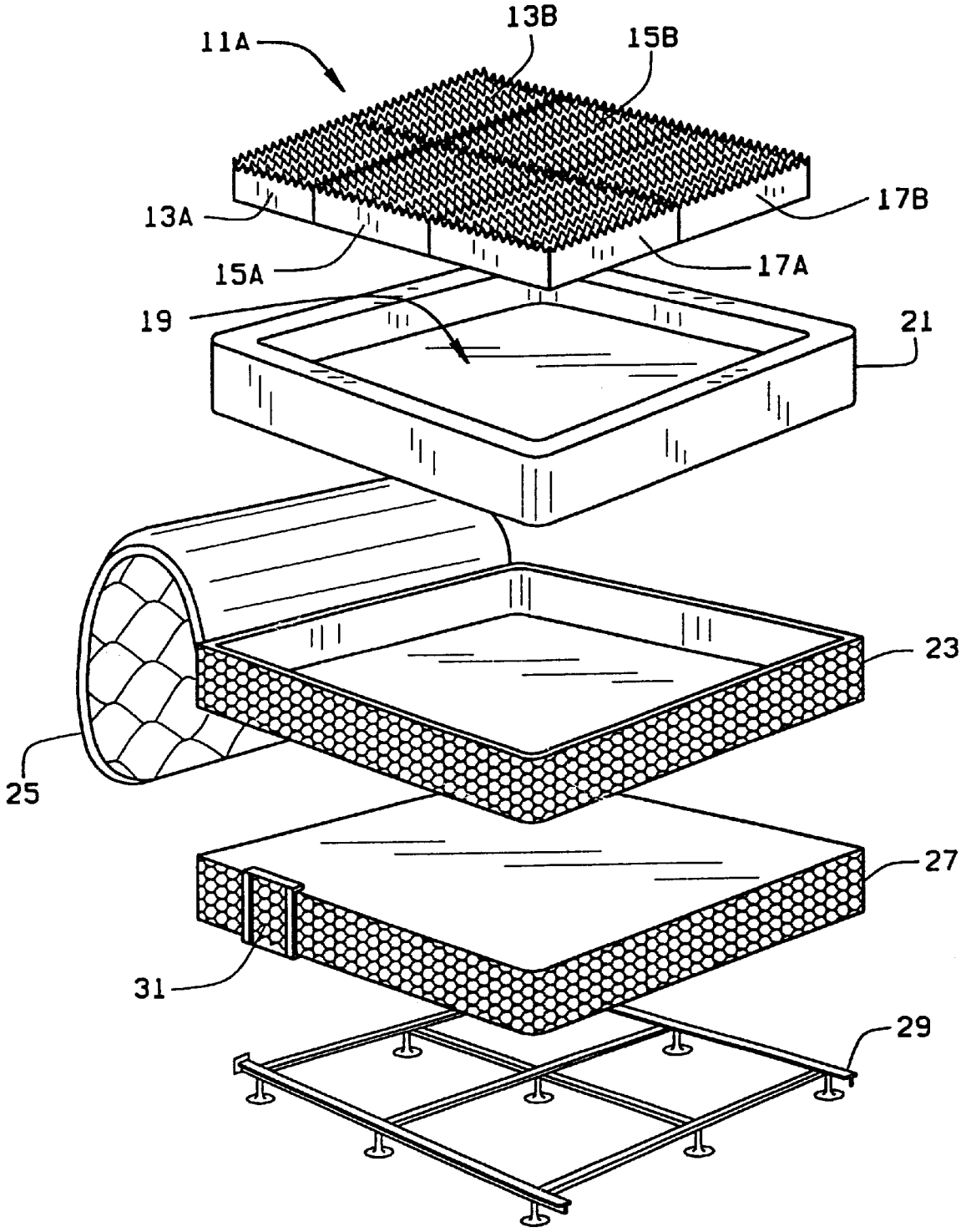
Figure 3:
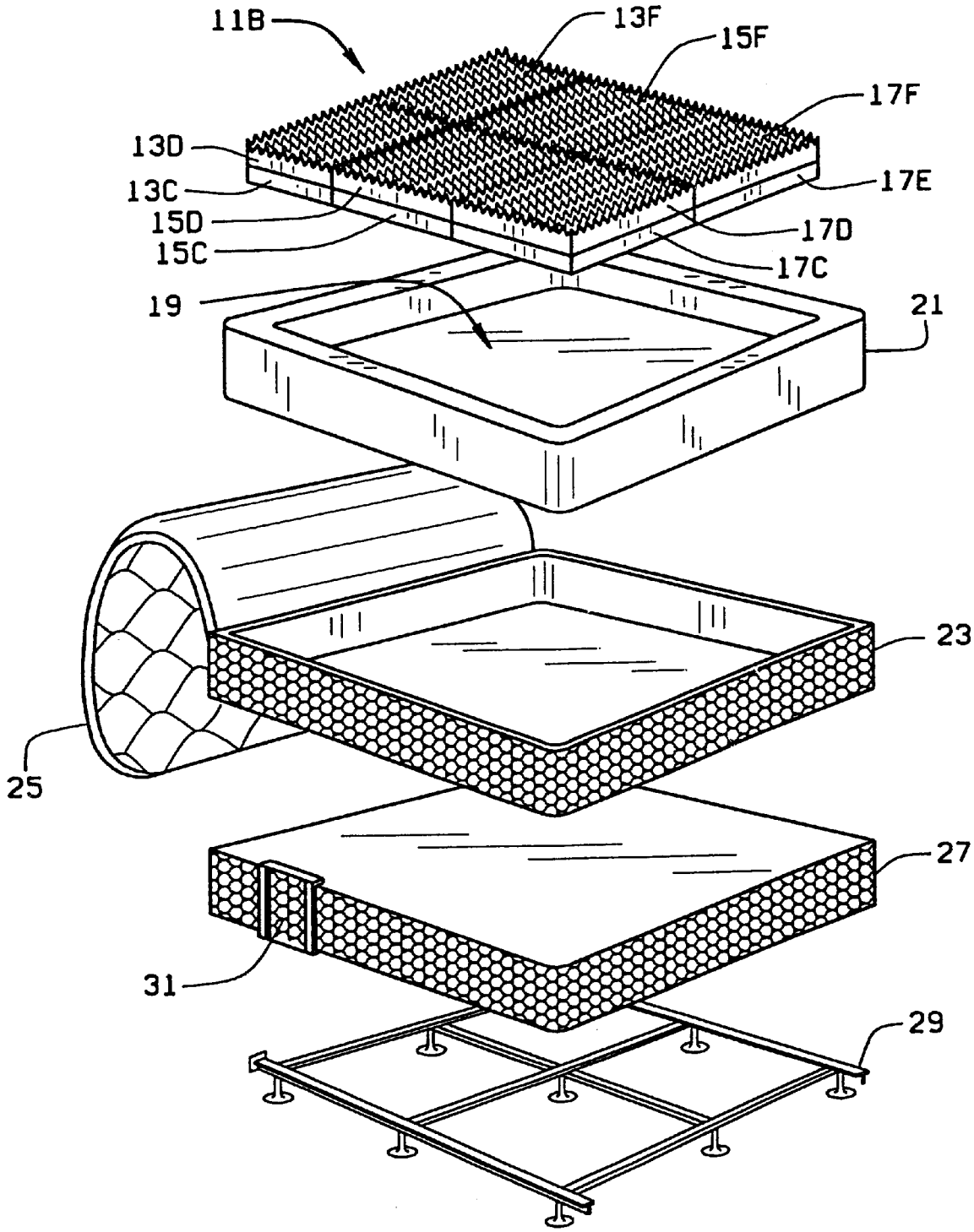

Similarly, see FIG. 3, each section of the system 11A in FIG. 2 may be replaced with a pair of foam sections so that there are twelve foam sections 13C, 13D, 13E, 13F, 15C, 15D, 15E, 15F, 17C, 17D, 17E, and 17F. Each of these sections may also have different densities or indentation load deflections, to provide dozens of different "feels" for the mattress using a minimum of components.

Figure 3A:
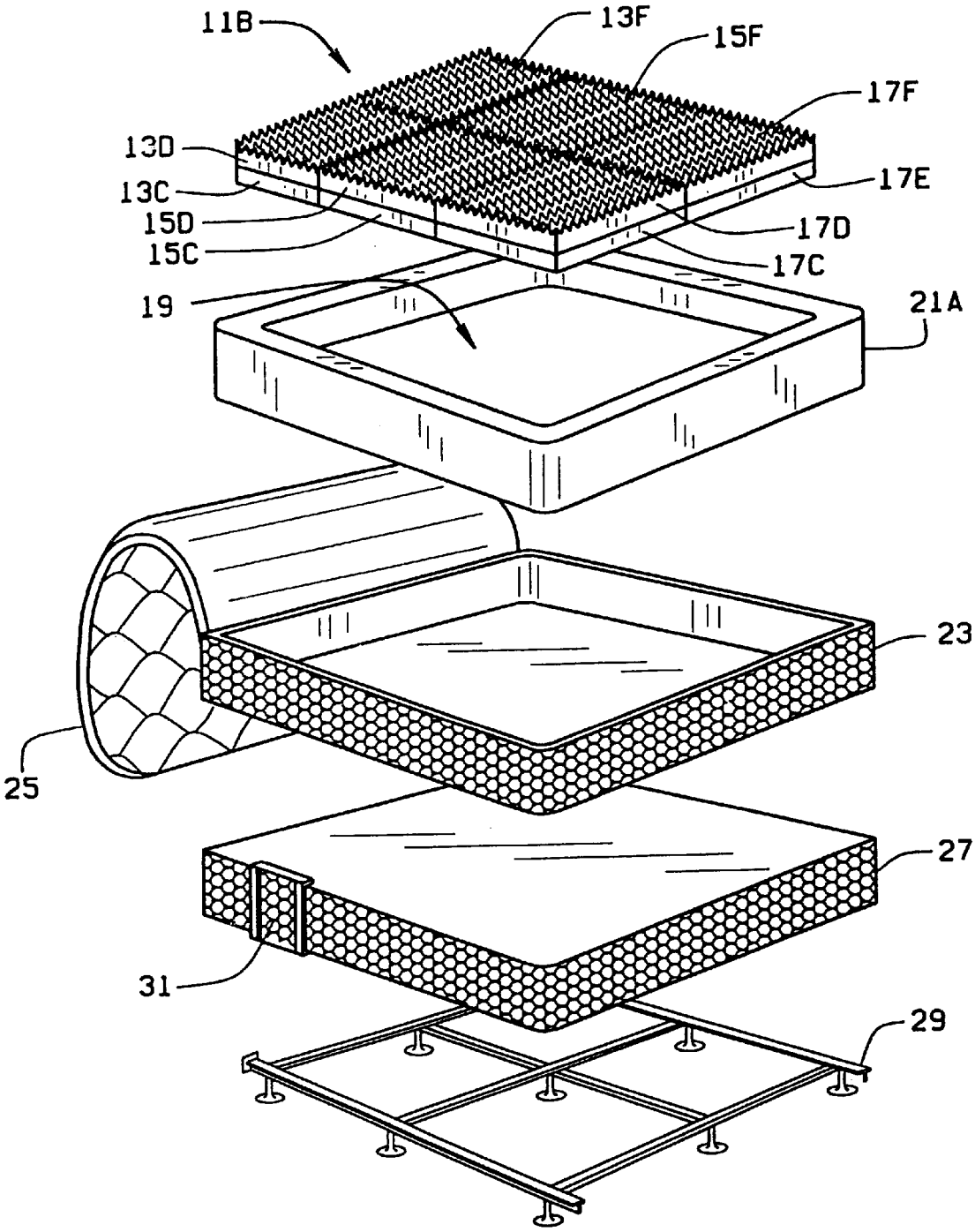
Figure 3B:
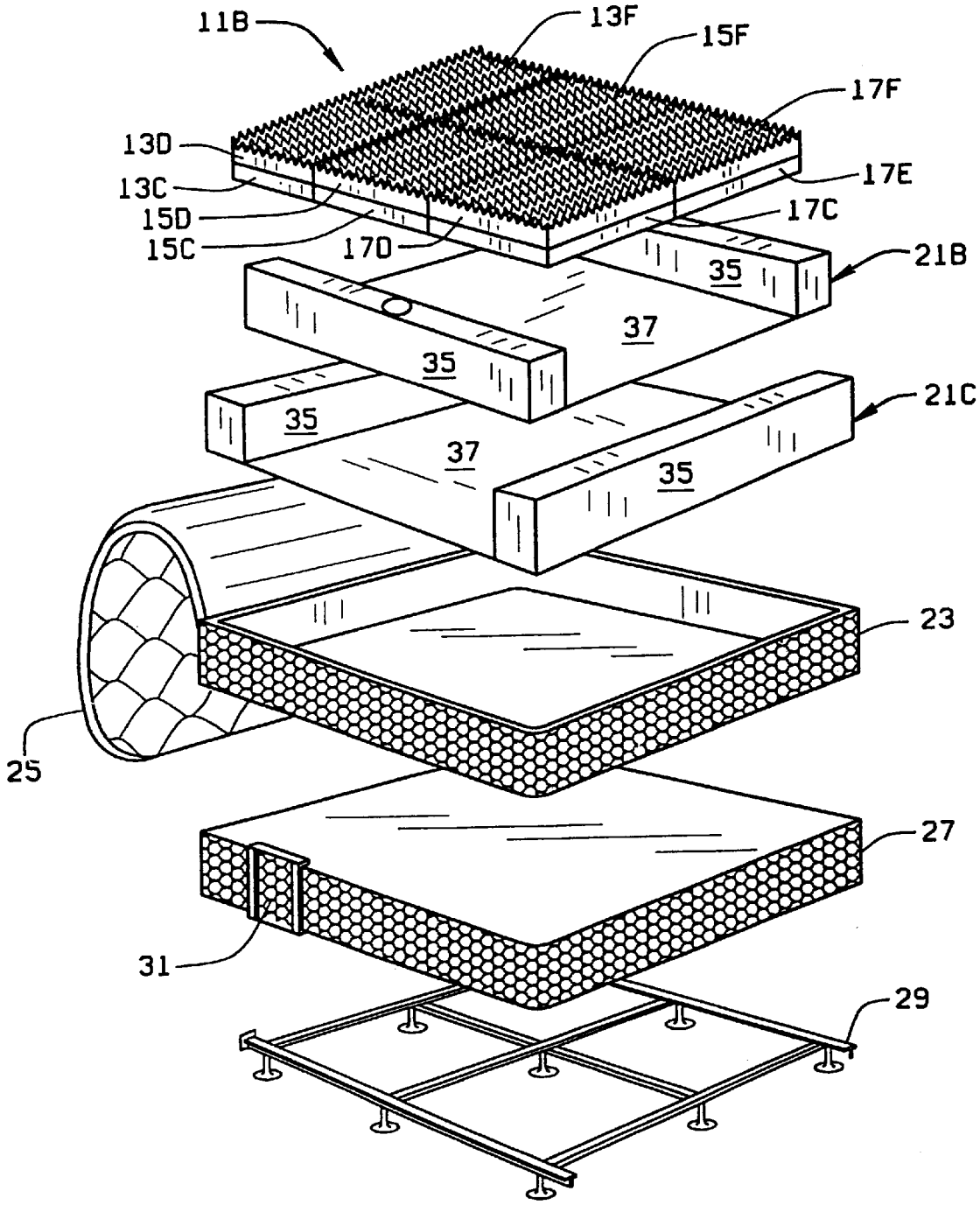

Turning to FIG. 3A, it can be seen that the multi-component system may be used with a bottomless foam member 21A as well. In addition, see FIG. 3B, foam member 21 or foam member 21A may be replaced with a two part foam member 21B, 21C which cooperate to hold the foam sections in place while significantly reducing the shipping of the system. In this further embodiment, the foam members have opposed sides 35 connected by a flexible sheet 37.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. A mattress system comprising:

a foam material forming the head section of a mattress;

an adjustable, inflatable fluid chamber forming the second section of the mattress;

a second piece of foam material forming the foot section of the mattress;

a cover in which in the sections are deposed, said cover being non-destructively and repeatably openable and removable from the sections to allow for removal and arrangement of the sections;

said sections having load responsive characteristics;

wherein all the sections are the same size and readily separable, movable and interchangeable by a user from one location in the mattress to another; and wherein the top and bottom surfaces of the sections are compatible for use as a sleeping surface, such that the sections can be individually flipped by the user to aid in turning of the mattress.

2. The mattress system as set forth in claim 1 wherein the load responsive characteristic is density.

3. The mattress system as set forth in claim 1 wherein the load responsive characteristic is indentation load deflection.

4. The mattress system as set forth in claim 1 further including a foam member having a cavity in which are disposed the sections, said member and sections disposed within and removable from the cover.

5. The mattress system as set forth in claim 4 wherein the foam member is open on the bottom.

6. The mattress system as set forth in claim 4 wherein the foam member is closed to form a bottom for the cavity.

7. The mattress system as set forth in claim 4 wherein the foam member is composed of polyurethane foam.

8. The mattress system as set forth in claim 1 wherein at least one of the sections has an outer surface having a pattern formed therein, said pattern having a series of ridges extending substantially above the surface of said section.

9. The mattress system as set forth in claim 1 further including third and fourth sections of foam material disposed adjacent the first and second sections, at least one of said third and fourth sections having a load responsive characteristic different from the load responsive characteristic of at least one of the first and second foam sections.

10. The mattress system as set forth in claim 9 wherein at least two of the sections have a different load responsive characteristic than the other sections.

11. The mattress system as set forth in claim 9 wherein the sections each have different load responsive characteristics.

12. The mattress system as set forth in claim 9 wherein the sections are all the same size and are readily separable and movable by a user from one location in the mattress to another to vary the load responsive characteristics of the mattress.

13. The mattress system as set forth in claim 9 further including additional sections of foam material disposed below the first four foam sections.

14. The mattress system as set forth in claim 13 wherein the sections are all the same size and are readily separable and movable by a user from one location of the mattress to another.

15. The mattress system as set forth in claim 1 wherein at least one of the foam sections is composed of a highly resilient foam such as latex foam.

16. The mattress system as set forth in claim 1 further including a comfort layer in the top of said cover.

17. The mattress system as set forth in claim 1 further including a foundation disposed under the sections, said foundation having a hidden compartment therein.

18. The mattress system as set forth in claim 1 wherein the sections are readily separable for shipment.

* * * * *